US005165556A

United States Patent [19]

Karhunen

[11] Patent Number: 5,165,556

[45] Date of Patent: Nov. 24, 1992

[54] APPARATUS FOR THE DAMPING OF THE SWING OF A LOADING DEVICE

[75] Inventor: Eero Karhunen, Hyvinkaa, Finland

[73] Assignee: Kone Oy, Helsinki, Finland

[21] Appl. No.: 723,028

[22] Filed: Jun. 28, 1991

[30] Foreign Application Priority Data

Jun. 29, 1990 [FI] Finland ..... 903291

[51] Int. Cl.[5] ..... B66C 13/06

[52] U.S. Cl. ..... 212/213; 212/97; 212/105; 212/147

[58] Field of Search ..... 212/147, 100, 101, 102, 212/104, 105, 98, 213, 97

[56] References Cited

U.S. PATENT DOCUMENTS

| | | | |
|---|---|---|---|
| 609,615 | 8/1898 | Faller | 212/105 |
| 770,545 | 9/1904 | Tamamura | 212/98 |
| 795,336 | 7/1905 | Burkholder | 212/100 |
| 839,287 | 12/1906 | Gutenkunst | 212/100 |
| 1,922,176 | 8/1933 | Rahland | 212/98 |
| 2,620,075 | 12/1952 | Hoyle et al. | 212/147 |
| 3,794,185 | 2/1974 | Kroll et al. | 212/105 |

FOREIGN PATENT DOCUMENTS

| | | | |
|---|---|---|---|
| 404234 | 9/1914 | France | 212/104 |
| 502830 | 4/1976 | U.S.S.R. | 212/147 |
| 1331804 | 8/1987 | U.S.S.R. . | |

*Primary Examiner*—Galen Barefoot
*Assistant Examiner*—Thomas J. Brahan
*Attorney, Agent, or Firm*—Sughrue, Mion, Zinn, Macpeak and Seas

[57] ABSTRACT

Apparatus for damping the swing of a loading device, said apparatus comprising a trolley provided with a hoisting machine having a hoisting rope on which a loading device is suspended, and downward-pointing brackets attached to the bottom of the trolley. A retaining lever provided with a joint, is mounted on each bracket enabling the lever to turn relative to the bracket. The loading device is so constructed that, when lifted up between the brackets, it will turn the retaining levers into a substantially vertical position. An anti-friction means is provided between the retaining lever and the loading device.

9 Claims, 2 Drawing Sheets

APPARATUS FOR THE DAMPING OF THE SWING OF A LOADING DEVICE

BACKGROUND OF THE INVENTION

1. Field of the Invention

The present invention relates to an apparatus for damping the swing of a loading device, said apparatus comprising a trolley provided with a hoisting machine, operating a hoisting rope on which a loading device is suspended, and downward-pointing brackets attached to the bottom of the trolley.

2. Description of the Related Prior Art

The swing of the loading device of a crane can be damped by using an even driving speed, avoiding jerks and large changes of speed, and the operator may hold the load steady while operating the crane However, these expedients are generally only applicable in the case of small loads In the hoisting of heavy and large loads, the damping systems mentioned below are used.

To damp the load swing, cranes generally employ systems where the load is lifted into a position between the brackets attached to the bottom of the trolley The loading device consists of several bars or it may have a structure resembling a funnel, a box, etc.

This type of damping system has the drawback that when the loading device is hoisted at a high speed into the position between the brackets, the gap between the device and the brackets must be sufficiently wide, which in turn leads to after-swing. A narrow gap between the loading device and the brackets produces large lateral forces as the loading device may hit the brackets, in which case the load may fall from the loading device. The above-described problem has been solved employing known techniques, whereby four brackets are placed symmetrically around a cylindrical loading device so that a suitable gap is left between the brackets and the loading device. Using a pneumatic device, damping elements designed to lock the loading device in place between the brackets are installed in this gap. Besides being complex, such a system is also very expensive and restricts the hoisting speed of the load.

The swing of the loading device can also be damped using a system based on telescopic or scissor guidance. Such systems allow the damping of the swing caused by the turning or lifting the load. These damping systems are expensive and require plenty of material and space.

SUMMARY OF THE INVENTION

The object of the present invention is to eliminate the drawbacks mentioned above. The invention aims at a simple, low-cost solution.

Among the advantages of the invention as compared to previously known techniques are the following: a simple construction; the loading device can be hoisted at a high speed into its position between the brackets, involving an increase in the capacity of the crane; the apparatus is a mechanical one, and consequently inexpensive, since no pneumatic or electric controls are used; and simultaneous operation of the hoisting and travelling machines is not necessary.

Accordingly, an apparatus for damping the swing of a loading device, having a trolley provided with a hoisting machine operating a hoisting rope on which a loading device is suspended, and downward-pointing brackets attached to the bottom of the trolley, comprises: a retaining lever, mounted on each of said downward-pointing bracket by a joint, enabling said lever to turn relative to said bracket; said loading device, dimensioned to turn said retaining levers into a substantially vertical position when lifted up between the brackets; and an anti-friction means, arranged between the retaining levers and the loading device.

BRIEF DESCRIPTION OF DRAWINGS

In the following, the invention is described by the aid of an example, referring to the attached drawings wherein.

DESCRIPTION OF PREFERRED EMBODIMENTS

Figure 1:
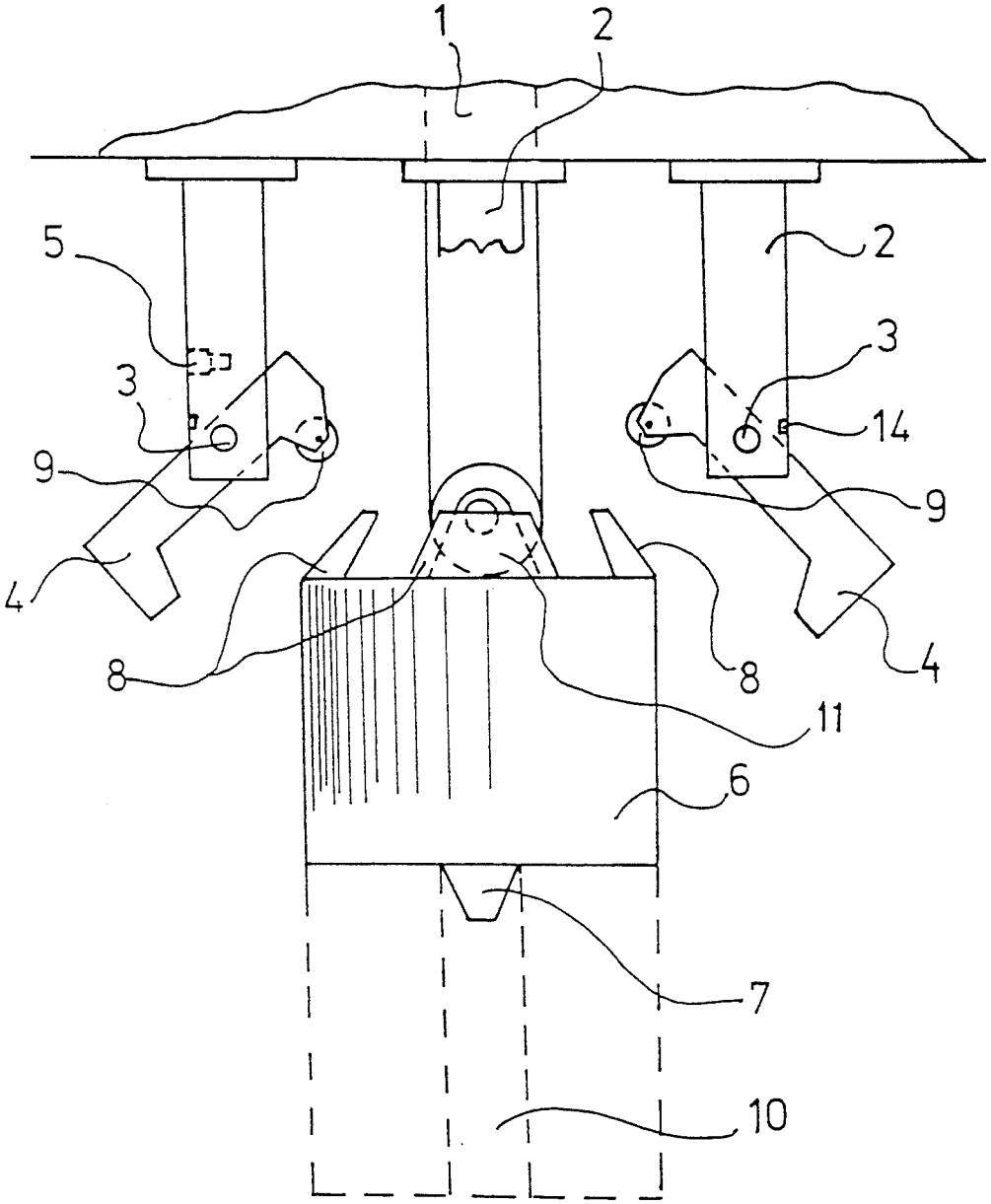
FIG. 1 illustrates a simplified side view of the apparatus, where the loading device travels vertically between the retaining levers.

FIG. 1 illustrates an embodiment of the apparatus of the invention, including a loading device 6 suspended from the trolley 1 by means of a pulley 11. The loading device is a cylindrical body with a vertical central axis and a jacket forming a vertical surface. The loading device is hoisted into the space between vertical brackets 2 provided on the trolley 1. The brackets 2 are so mounted on the frame of the trolley 1 that they extend vertically downwards from the bottom of the trolley frame. There are four brackets and they are placed symmetrically around the loading device, at equal distance from each other. In addition, the brackets are so located that, when the loading device 6 is lifted, a suitable gap will separate the brackets from the loading device. The lower part of each bracket is provided with a vertical slot of sufficient length, which opens at the lower end of the bracket. The lower end of each bracket is also provided with a hole for the trunnion of a joint 3. The trunnion of joint 3 is in a horizontal position. A retaining lever 4 is mounted on said trunnion and it may turn about joint 3 in the slot of the bracket. The retaining levers 4 are dimensioned and mounted so that, when disengaged, they assume an inclined position with the lower end farther apart from the loading device than the upper end. To make this possible, the retaining levers 4 are so constructed that, their center of gravity is offset relative to the joint 3. The center of gravity of the lever when in vertical position, lies on the side facing the loading device 6. For simplifying the figures, only two brackets are shown in full and only the upper part of the other two brackets is shown. The dimensions of the retaining levers 4 are chosen in accordance with the strain imposed on them. The upper end of each retaining lever is provided with a metallic runner 9 which acts as an anti-friction device, reducing wear. The runner rolls along a bevel or a bevel guide 8 provided at the upper end of the loading device 6. There are four bevel guides. Alternatively, the bevel guides may comprise a frusta-conical solid ring, whose diameter at the lower edge corresponds to the diameter of the upper part of the loading device 6, while at the upper edge, the ring has a suitable smaller diameter. When the loading device 6 is lifted between brackets 2, the bevels or bevel guides 8 will first contact the runners 9 of the retaining levers 4. Thereafter, while the loading device is further lifted, the retaining levers 4 are rotated to a vertical position, so that at the end of the lifting movement, both the upper and the lower end of each retaining lever 4 are firmly pressed against the loading device 6. As specified above, there are four retaining levers 4 placed symmetrically around the loading device 6, thus enabling the loading device 6 to be firmly locked in place when lifted.

Since the retaining levers 4 are freely turnable about their joints, the apparatus would not function well because of excessive lever swing. For example, in a situation where the loading device is lifted up between the retaining levers 4, the first contact of the loading device with the runner 9 would cause a thrust. As a result, the lower end of the lever will hit the respective side of the loading device. To eliminate this drawback, each bracket is provided with a shock damper 5 which damps the motion of the retaining lever when the latter is turned towards the vertical position. The shock damper is mounted in a horizontal position and arranged to run into the rear end of the upper part of the retaining lever at the beginning of the damping action. The shock damper is provided with a spring which returns the shock damper into its rest position and pushes the retaining levers from the vertical position into an oblique position when the loading device 6 is lowered from the position between the retaining levers 4. A free swing of the retaining levers 4 about their balanced position could appear once the loading device is completely disengaged. The retaining levers would also swing freely during the travel of the trolley if they are not suitably retained. To prevent this free swing, each bracket is provided with a stopper 14 located at a suitable place behind the retaining lever.

Figure 2:
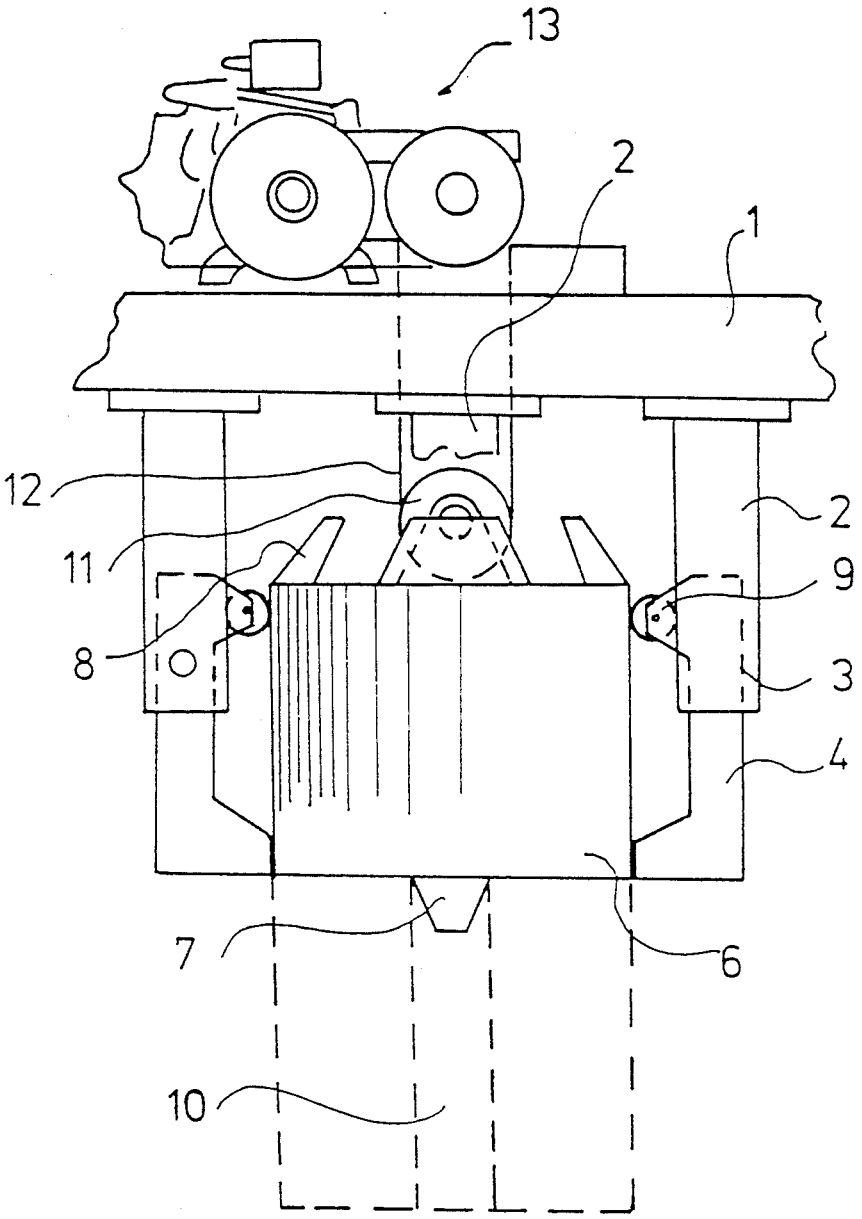
FIG. 2 illustrates a simplified side view of the apparatus where the loading device is locked by means of retaining levers.

FIG. 2 illustrates the embodiment depicted in FIG. 1 in a situation where the loading device 6 has been lifted and is held between the retaining levers 4, which have engaged the loading device 6 as guided by the bevel 8. FIG. 2 also shows the hoisting machine 13.

The loading device 6 is provided with a conical guide 7 which is lowered into the core of a paper roll to create a vacuum using a vacuum pump provided in the loading device 6. The hoisting rope 12 is connected to the loading device 6 via pulley 11. One end of the hoisting rope is attached to the machine 13 of the trolley 1 while the other end is attached to the trolley frame. The bevels or bevel guides 8 are made of metal and the slope angle is designed according to the deceleration of the hoisting motion. In the highest position, the loading device is completely locked and the damping action is fully effective.

It is obvious to a person skilled in the art that different embodiments of the invention are not restricted to the examples described above, but that they may instead be varied within the scope of the following claims. The runners may be replaced e.g. with a coat of teflon or an alternative antifriction material. Similarly, the runners may be placed on the loading device 6, in which case the latter need not be provided with bevel guides 8.

I claim:

1. An apparatus for damping the swing of a loading device, having a trolley provided with a hoisting machine operating a hoisting rope on which a loading device is suspended, and downward-pointing brackets attached to the bottom of the trolley, comprising:

a retaining lever, mounted on each of said downward-pointing brackets by a joint, enabling said lever to turn relative to said bracket;

said loading device, dimensioned to turn said retaining levers into a substantially vertical position when lifted up between the brackets; and a runner placed at the upper end of each retaining lever to act as an anti-friction means.

2. An apparatus as claimed in claim 1, wherein the location of the center of gravity of each retaining lever is so arranged that, in a rest position the lower ends of said retaining levers are spaced further apart than the corresponding upper ends.

3. An apparatus as claimed in claim 1 or 2, wherein the upper part of the loading device is provided with a bevel means which turns the retaining levers into a vertical position when the loading device is lifted between the brackets.

4. An apparatus as claimed in claim 1 or 2, wherein said joint comprises a horizontal trunnion enabling said retaining lever to pivot relative to said respective bracket on said horizontal trunnion arranged in said bracket.

5. An apparatus as claimed in claim or 2 wherein each bracket is provided with a shock damper having a return spring, designed to damp the motion of the retaining lever when the retaining lever approaches the vertical position.

6. An apparatus for damping the wing of a loading device, having a trolley provided with a hoisting machine which operates said loading device, comprising:

a plurality of downwardly-pointing brackets attached to the bottom of the trolley and positioned around said loading device when lifted therebetween;

a like number of retaining levers mounted on said downwardly-pointing brackets, for pivoting between a rest position and a locking position;

an upper and a lower engaging end provided on each lever, directly engaging said loading device in said locking position; and anti-friction means, arranged between said engaging ends and said loading device, such that, when said loading device is lifted up between said brackets, said loading device contacts said anti-friction means, biasing said lever between said rest position and said locking position.

7. An apparatus as claimed in claim 6 wherein said retaining levers, in said rest position, assume an inclined orientation having said lower ends spaced further apart than said upper ends, and in said locking position, directly engage the loading device with said upper and lower ends.

8. An apparatus as claimed in claim 6 further comprising bevel means provided at an upper part of said loading device for cooperating with said anti-friction means, such that said anti-friction means engage said bevel means and gradually turn said retaining levers into said locking position.

9. An apparatus as claimed in claim 6 wherein said brackets are provided with shock dampers having return springs, for damping the motion of said retaining levers when the retaining levers approach the locking position.

* * * * *